US010925311B2

(12) United States Patent
Nappi et al.

(10) Patent No.: US 10,925,311 B2
(45) Date of Patent: Feb. 23, 2021

(54) SMOKING ARTICLE INCLUDING FLOW RESTRICTOR

(71) Applicant: PHILIP MORRIS PRODUCTS S.A., Neuchatel (CH)

(72) Inventors: Leonardo Nappi, Hauterive (CH); Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 921 days.

(21) Appl. No.: 14/440,722

(22) PCT Filed: Dec. 17, 2013

(86) PCT No.: PCT/EP2013/077005
§ 371 (c)(1),
(2) Date: May 5, 2015

(87) PCT Pub. No.: WO2014/102096
PCT Pub. Date: Jul. 3, 2014

(65) Prior Publication Data

US 2015/0289561 A1 Oct. 15, 2015

(30) Foreign Application Priority Data

Dec. 31, 2012 (EP) ..... 12199824

(51) Int. Cl.
*A24D 3/04* (2006.01)
*A24D 3/02* (2006.01)

(52) U.S. Cl.
CPC ..... *A24D 3/04* (2013.01); *A24D 3/02* (2013.01); *A24D 3/045* (2013.01)

(58) Field of Classification Search
CPC ..... A24D 3/04; A24D 3/02; A24D 3/045
See application file for complete search history.

(56) References Cited

U.S. PATENT DOCUMENTS 5,265,626 A * 11/1993 Schneider ..... A24D 3/04 131/194
6,918,867 B2 7/2005 Scherbarth et al.
(Continued)

FOREIGN PATENT DOCUMENTS

CN 101562998 A 10/2009
CN 101715305 A 5/2010
(Continued)

OTHER PUBLICATIONS

"Cigarette Dimensions", Dimensions Info, May 5, 2011, accessed Oct 25, 2016 at dimensionsinfo.com.*
(Continued)

*Primary Examiner* — Joseph S Del Sole
*Assistant Examiner* — Jamel M Nelson
(74) *Attorney, Agent, or Firm* — Oblon, McClelland, Maier & Neustadt, L.L.P.

(57) ABSTRACT

There is provided a filter for a smoking article, the filter including a filter segment of filter material and a flow restrictor. The flow restrictor is embedded in the filter segment and surrounded on all sides by the filter material. A cross sectional dimension of the flow restrictor measured perpendicular to a longitudinal direction of the filter is between about 60% and about 95% of the diameter of the filter segment. There is also provided a smoking article including such a filter.

12 Claims, 2 Drawing Sheets

(56) References Cited

U.S. PATENT DOCUMENTS

| | | | | |
|---|---|---|---|---|
| 7,878,962 | B2 | 2/2011 | Karles et al. | |
| 2005/0066982 | A1 | 3/2005 | Clark et al. | |
| 2007/0012327 | A1 | 1/2007 | Karles et al. | |
| 2007/0068540 | A1* | 3/2007 | Thomas | A24D 3/0295 131/88 |
| 2007/0235050 | A1 | 10/2007 | Li et al. | |
| 2008/0216848 | A1* | 9/2008 | Li | A24C 5/475 131/94 |
| 2008/0302373 | A1 | 12/2008 | Stokes et al. | |
| 2010/0294290 | A1* | 11/2010 | Zhang | A24B 15/283 131/328 |
| 2011/0100387 | A1 | 5/2011 | Karles et al. | |
| 2011/0190105 | A1 | 8/2011 | Fallon | |
| 2011/0230320 | A1 | 9/2011 | Stokes et al. | |
| 2011/0232659 | A1 | 9/2011 | Ercelebi et al. | |
| 2012/0037173 | A1 | 2/2012 | Clark et al. | |
| 2014/0026900 | A1 | 1/2014 | Karles et al. | |

FOREIGN PATENT DOCUMENTS

| | | | |
|---|---|---|---|
| EP | 0 649 607 | A2 | 4/1995 |
| EP | 1 397 967 | A1 | 3/2004 |
| FR | 2 345 092 | A1 | 10/1977 |
| JP | 52-105300 | | 9/1977 |
| JP | 2-59716 | B2 | 12/1990 |
| JP | 7-250665 | A | 10/1995 |
| JP | 2004-516814 | A | 6/2004 |
| JP | 2008-539717 | | 11/2008 |
| JP | 2009-508524 | | 3/2009 |
| JP | 2010-520775 | A | 6/2010 |
| JP | 2016-501547 | | 1/2016 |
| WO | WO 2005/077521 | A1 | 8/2005 |
| WO | 2006/117697 | A1 | 11/2006 |
| WO | WO 2007/010407 | A2 | 1/2007 |
| WO | WO 2007/110650 | A1 | 10/2007 |
| WO | WO 2008/059377 | A2 | 5/2008 |
| WO | WO 2010/133334 | A1 | 11/2010 |
| WO | WO 2011/077141 | A1 | 6/2011 |
| WO | WO 2011/117743 | A1 | 9/2011 |
| WO | WO 2012/123702 | A1 | 9/2012 |
| WO | 2012/156705 | A1 | 11/2012 |
| WO | WO 2013/000967 | A1 | 1/2013 |

OTHER PUBLICATIONS

"More Innovation from CTC", Aug./Oct. 2002, RYO Magazine, vol. III, No. 3, accessed at ryomagazine.com on Feb 9, 2017.*

"Compressive Strength Testing of Plastics", MatWeb, accessed at matweb.com on Aug 23, 2017. (Year: 2017).*

International Search Report dated Jul. 1, 2014 in PCT/EP2013/077005 filed Dec. 17, 2013.

Office Action dated Oct. 23, 2017 in corresponding Japanese Patent Application No. 2015-550028 (with English Translation), 18 pages.

Office Action dated Oct. 3, 2018, in Japanese Patent Application No. 2015-550028.

Office Action dated Nov. 8, 2018, in European Patent Application No. 13821461.4.

Korean Office Action dated May 14, 2020, in corresponding Korean Patent Application No. 10-2015-7019218 (with English translation).

Chinece Office Action with English translation dated Apr 10, 2018 in the corresponding Chinese Patent Appiication No. 201380068942.7, (24 pages).

General Handbook. On Plastics by Jun Cheng, pp. 48-50, National Defense Industry Press, May 2007.

Office Action dated Dec. 17, 2020 in corresponding Japan Patent Application No. 2019-22220 (with English translation).

* cited by examiner

SMOKING ARTICLE INCLUDING FLOW RESTRICTOR

CROSS REFERENCE TO RELATED APPLICATION

This application is a U.S. national phase application under 35 U.S.C. § 371 of PCT/EP2013/077005, filed on Dec. 17, 2013, and claims the benefit of priority under 35 U.S.C. § 119 from prior EP Application No. 12199824.9, filed on Dec. 21, 2012, the entire contents of each of which are incorporated herein by reference.

The present invention relates to a filter for a smoking article, and a smoking article comprising a filter.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco can be a single type of tobacco or a blend of two or more types of tobacco.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Smoking articles, particularly cigarettes, generally comprise a filter aligned in end-to-end relationship with a source of material, such as a tobacco rod or another aerosol forming substrate. Typically, the filter includes a plug of cellulose acetate tow attached to the tobacco rod or substrate by tipping paper. Ventilation of mainstream smoke can be achieved with a row or rows of perforations in the tipping paper about a location along the filter.

Ventilation may reduce both the particulate phase and the gas phase constituents of the mainstream smoke. However, smoking articles having high levels of ventilation may have levels of resistance-to-draw (RTD) which are too low to be considered acceptable to a consumer. The inclusion of, for example, one or more high density cellulose acetate filter segments may be used to increase to an acceptable level the overall RTD of smoking articles with high ventilation. However, high density cellulose acetate filter segments typically reduce particulate phase (for example, tar) deliveries while having little or no effect on gas phase (for example, carbon monoxide) deliveries. One way to solve this is to include a restrictor element in the filter. For example, WO-A-2010/133334 and US-A-2007/0235050 describe restrictor elements which increase RTD without filtering the smoke. If used with high ventilation, a restrictor element can increase RTD while both the particulate phase and the gas phase constituents of the mainstream smoke are reduced.

It would be desirable to provide a filter for a smoking article having an improved flow restricting element which is straightforward and inexpensive to manufacture, and to assemble into the filter.

According to a first aspect of the invention, there is provided a filter for a smoking article, the filter comprising: a filter segment of filter material, the filter segment having a diameter measured perpendicular to a longitudinal direction of the filter; and a flow restrictor embedded in the filter segment and surrounded on all sides by the filter material, wherein a cross sectional dimension of the flow restrictor measured perpendicular to a longitudinal direction of the filter is between about 60% and about 95% of the diameter of the filter segment, and wherein the flow restrictor is substantially spherical, the cross sectional dimension of the flow restrictor measured perpendicular to a longitudinal direction of the filter being a diameter of the spherical flow restrictor.

The flow restrictor requires less material than many prior art restrictor elements. This reduces the weight and cost of the flow restrictor. The filter according to the invention provides flexibility for shorter filter designs, since the flow restrictor increases the RTD in a relatively short filter length. This is particularly advantageous since it may allow the filter to be manufactured using less filter material. Depending on the specifics of the design, the flow restrictor may be easy to produce without the need for injection moulding. This may mean that the flow restrictor is quicker, easier and cheaper to manufacture than many prior art restrictor elements. The filter according to the invention is also easy to manufacture, since the flow restrictor may be incorporated directly amongst the fibres of the filter material tow. Thus, conventional manufacturing techniques may be used in which continuous tow material, with embedded flow restrictors, is cut into filter segments. No separate step of inserting the flow restrictor is required.

The flow restrictor preferably comprises an air-impermeable material. The term "air-impermeable material" is used throughout this specification to mean a material not allowing the passage of fluids, particularly air and smoke, through interstices or pores in the material. If the flow restrictor comprises a material impermeable to air and smoke, air and smoke drawn through the filter are forced to flow around the flow restrictor and through a reduced cross section of filter material. Thus, the flow restrictor reduces the permeable cross-sectional area of the filter. Preferably, the cross-sectional area of the flow restrictor is between about 35% and about 90% of the cross-sectional area of the filter segment. That is, preferably, the permeable cross-sectional area of the filter is between about 10% and about 65% of the cross-sectional area of the filter segment. This increases the RTD of the filter to a level which is acceptable to a consumer. Although the flow restrictor may comprise air-impermeable material, this does not preclude the flow restrictor having a shape which includes one or more air flow channels. In some cases the flow restrictor diverts all or substantially all of the smoke and air from flowing through the central portion of the filter, while in other cases the flow restrictor may force most of the smoke and air around the flow restrictor while still allowing a small amount of smoke and air through the restrictor element, for example through one or more channels in the flow restrictor.

Diverting the flow to the edge of the filter may be particularly effective in increasing RTD since flow of air or smoke or both air and smoke may be predominantly through the central portion of the filter. The size and shape of the flow restrictor and the type of filter material may be selected to affect the RTD in a desired manner. For example, when placed in a single filter segment without ventilation, the flow restrictor may be able to generate a RTD in the range of approximately 200 mm $H_2O$ (about 1960 Pa) to approximately 500 mm $H_2O$ (about 4900 Pa). Preferably, the flow restrictor is able to generate a RTD between approximately 250 mm $H_2O$ (about 2450 Pa) and approximately 400 mm $H_2O$ (about 3920 Pa).

In this specification, the terms "upstream" and "downstream" are used to describe relative positions between elements of the filter or smoking article in relation to the direction of mainstream smoke as it is drawn from a lit end of the smoking article through the filter.

The cross sectional dimension of the flow restrictor is between about 60% and about 95% of the diameter of the filter segment. If the flow restrictor and filter segment have circular cross sections, this corresponds to the permeable cross sectional area being reduced by the flow restrictor to between about 10% and about 64% of cross sectional area of the filter segment. Preferably, the cross sectional dimension of the flow restrictor is between about 70% and about 90% of the diameter of the filter segment. If the flow restrictor and filter segment have circular cross sections, this corresponds to the permeable cross sectional area being reduced by the flow restrictor to between about 19% and about 51% of cross sectional area of the filter segment. More preferably, the cross sectional dimension of the flow restrictor is between about 70% and about 80% of the diameter of the filter segment. If the flow restrictor and filter segment have circular cross sections, this corresponds to the permeable cross sectional area being reduced by the flow restrictor to between about 36% and about 51% of cross sectional area of the filter segment. Even more preferably, the cross sectional dimension of the flow restrictor is between about 72% and about 78% of the diameter of the filter segment. If the flow restrictor and filter segment have circular cross sections, this corresponds to the permeable cross sectional area being reduced by the flow restrictor to between about 39% and about 48% of cross sectional area of the filter segment.

Preferably, the diameter $D_F$ of the filter segment is between about 3.8 mm and about 9.5 mm. More preferably, the diameter $D_F$ of the filter segment is between about 4.6 mm and about 7.8 mm. Even more preferably, the diameter $D_F$ of the filter segment is about 7.7 mm. The diameter of the filter segment is measured perpendicular to the longitudinal axis of the filter and the smoking article.

The cross sectional dimension of the flow restrictor is between about 60% and about 95% of the diameter of the filter segment. However, within that range, the size and shape of the flow restrictor relative to the diameter $D_F$ of the filter segment may be selected to provide the desired level of RTD. The flow restrictor may have a cross sectional dimension of between about ($D_F$-3.0 mm) and about ($D_F$-0.2 mm). The flow restrictor may have a cross sectional dimension of between about ($D_F$-2.8 mm) and about ($D_F$-0.4 mm). The flow restrictor may have a cross sectional dimension of between about ($D_F$-1.5 mm) and about ($D_F$-0.8 mm). The flow restrictor may have a cross sectional dimension of between about ($D_F$-1.2 mm) and about ($D_F$-1.0 mm). The flow restrictor may have a cross sectional dimension of about ($D_F$-1.73 mm). The flow restrictor may have a cross sectional dimension of about ($D_F$-0.58 mm). In one preferred embodiment, the cross sectional dimension of the flow restrictor is about 5.55 mm. In another preferred embodiment, the cross sectional dimension of the flow restrictor is about 6.0 mm. In another preferred embodiment, the cross sectional dimension of the flow restrictor is about 7.15 mm.

The expression "surrounded on all sides" is used throughout this specification to mean that the flow restrictor is directly adjacent filter material in the upstream and downstream (longitudinal) directions and also in the transverse direction. That is, the flow restrictor is completely embedded within the filter material, and is not in a separate cavity. Preferably, flow restrictors are incorporated into the filter material during manufacture of the filter material. For example, the flow restrictors may be incorporated amongst the fibres of a continuous rod of filter material, which may then be cut into filter segments.

Preferably, the flow restrictor is non-compressible. The term "non-compressible" is used throughout this specification to mean resistant to compression from any of: manual handling as the smoking article is removed from a pack, digital compression (that is, by a user's fingers on the filter), buccal compression (that is, by a user's lips or teeth on the mouth end of the filter) or the manual extinguishing ("stubbing out") process. That is, the term "non-compressible" is used to mean not deformable or destructible in the normal handling of a smoking article during manufacture and use.

Preferably, the flow restrictor has a compressive yield strength greater than about 8.0 kPa. More preferably, the flow restrictor has a compressive yield strength greater than about 12.0 kPa. The compressive yield strength is defined as the value of uniaxial compressive stress reached when there is a permanent deformation of the flow restrictor.

Preferably, the flow restrictor has a compressive strength at a deformation of 10% greater than about 50.0 kPa. The compressive strength at a deformation of 10% is defined as the value of uniaxial compressive stress reached when there is a 10% deformation (that is, a 10% change in one cross sectional dimension) of the flow restrictor.

The compressive yield strength and the compressive strength at a deformation of 10% may both be obtained experimentally by means of standardized test ISO 604. As will be appreciated by the skilled person, in this test, the specimen (flow restrictor) is compressed by compressive plates along an axis that corresponds to the pressure that a smokers' fingers would exert on the restrictor when the smoker is grasping the smoking article. The test is conducted at a constant rate of displacement until the load or deformation reaches a predetermined value. The load sustained by the specimen (flow restrictor) is measured during the procedure.

The flow restrictor may comprise any suitable material or materials. Preferably, the flow restrictor comprises one or more air-impermeable materials. Examples of suitable materials include, but are not limited to, gelatin or other types of hydrocolloids, alginate, carboxymethyl cellulose (CMC), cellulose, starch, polylactic acid, poly(butylene succinate) and its copolymers, poly(butylene adipate-co-terephthalate) and combinations thereof. The flow restrictor may comprise compressed tobacco, tobacco dust, ground tobacco, other flavourants or a combination thereof.

Preferably, the flow restrictor is formed from a dissolvable polymeric material formed of one or more water soluble polymers. More preferably the dissolvable polymeric material is formed of one or more water soluble thermoplastics. The term "dissolvable" means that the polymeric material is capable of dissolving into a solution with a water solvent. This is achieved through the use of one or more water soluble materials to form the material. The flow restrictor may be made entirely of the dissolvable polymeric material or the dissolvable polymeric material may be combined with inert components, such as inert inorganic fillers, which may or may not be dissolvable. The use of a dissolvable material to form the flow restrictor advantageously increases the rate of disintegration of the filter after it has been discarded. Alternatively or additionally, the flow restrictor may comprise a material which disperses into a suspension or colloid with the addition of water.

More preferably, the flow restrictor is formed from a biodegradable polymeric material. Preferred polymers are fully biodegradable as defined in the Aqueous Aerobic Biodegradation Test (Sturm test) outlined in European standard EN13432. Preferred biodegradable polymers include starch.

The flow restrictor may be solid or may include one or more air flow channels or may comprise a shell and a core. If the flow restrictor comprises a core and shell structure, the core may be empty. In some embodiments, the flow restrictor may include one or more air flow channels through the flow restrictor so that some of the air and smoke drawn through the filter is not forced around the flow restrictor. In preferred embodiments, the flow restrictor forms a solid barrier comprising air-impermeable material to force the flow of smoke and air around the flow restrictor, as discussed herein. The flow restrictor may be manufactured using a fast continuous process such as a rotary-die process.

The flow restrictor is substantially spherical. This may include flow restrictors having a sphericity value of at least about 0.9, and preferably a sphericity value of approximately 1. Sphericity is a measure of how spherical an object is, with a perfect sphere having a sphericity value of 1. The cross sectional dimension of the flow restrictor measured perpendicular to a longitudinal direction of the filter is a diameter of the sphere. The at least one cross sectional dimension is measured when the flow restrictor is disposed in the filter, with the measurement being taken perpendicular to the longitudinal axis of the filter between the two points of the flow restrictor furthest from one another. The two points that are furthest from one another may be at the same longitudinal position along the filter, or they may be at different longitudinal positions. A spherical flow restrictor is easy to manufacture and, since it is radially symmetric, the same RTD may be obtained regardless of the orientation that the flow restrictor adopts in the filter material.

Preferably, only a single flow restrictor is embedded in the filter segment. However, additional flow restrictors may be provided. If additional flow restrictors are provided in the filter, they may have the same or different properties as one another.

The filter material may comprise any suitable material or materials. The type of filter material may be selected to provide the desired level of RTD. Examples of suitable materials include, but are not limited to, cellulose acetate, cellulose, reconstituted cellulose, polylactic acid, polyvinyl alcohol, nylon, polyhydroxybutyrate, thermoplastic material, such as starch, formed into an open cell foam, and combinations thereof. All or part of the filter may include activated carbon. The filter may include an adhesive or plasticiser or a combination thereof.

Preferably, the filter material is of low particulate efficiency. Preferably, the filter segment comprises fibres of between approximately 3.5 denier per filament (dpf) and approximately 12.0 dpf. In a preferred embodiment, the filter segment comprises large diameter fibres of approximately 5.5 dpf. Preferably, the filter segment comprises fibres of between approximately 15000 total denier (td) and approximately 50000 td. In a preferred embodiment, the filter segment comprises large diameter fibres of approximately 35000 td.

The filter may include one or more additional filter elements upstream, downstream or both upstream and downstream of the filter segment. If the filter includes additional elements, the filter segment with embedded flow restrictor is only a filter component of the smoking article filter, rather than the whole smoking article filter. The additional filter elements may be axially aligned with the filter segment. For example, the filter may further include a plug or plugs or disc or discs of filter material downstream of the filter segment, a plug or plugs or disc or discs of filter material upstream of the filter segment, or plugs or discs of filter material downstream and upstream of the filter segment. Alternatively or additionally, the filter may further include a hollow tube or tubes downstream of the filter segment, a hollow tube or tubes upstream of the filter segment, or hollow tubes downstream and upstream of the filter segment. If more than one hollow tube is provided, the hollow tubes may have the same or different dimensions.

Preferably, the filter forms a mouth end cavity. The filter may be open or hollow or tubular at the mouth end. Preferably, the material of the flow restrictor is impermeable to air and smoke, so air and smoke drawn through the filter are forced to flow around the flow restrictor. Downstream of the flow restrictor, however, the inventors have found that the air and smoke tend to return to a flow path predominantly in the centre of the filter. Because of this, the centrally focussed smoke flow may cause staining of the filter material downstream of the flow restrictor and the centre of any filter elements downstream of the filter segment. However, by forming a mouth end cavity in the filter, visible, unsightly staining of the mouth end can be reduced.

Nevertheless, because the flow restrictor is embedded in the segment of filter material and surrounded on all sides by the filter material, at least some filter material will be present along and around the centre of the filter, downstream of the flow restrictor. This filter material may therefore be stained by smoke that has passed around the flow restrictor and is tending to return to a flow path predominantly in the centre of the filter. Such staining may be most noticeable to a consumer at the furthest downstream end of this filter material. Therefore, various measures may be taken to reduce visible staining of this furthest downstream end of filter material in the filter.

For example, the furthest downstream end of filter material in the filter may be positioned close to the downstream end of the flow restrictor, where the smoke flow is relatively dispersed. In this case, the furthest downstream end of filter material in the filter is preferably less than about 8 mm from the downstream end of the flow restrictor, more preferably less than about 4 mm from the downstream end of the flow restrictor, and even more preferably less than about 2 mm from the downstream end of the flow restrictor. In some embodiments, the furthest downstream end of filter material in the filter is more than about 0.2 mm from the downstream end of the flow restrictor.

Alternatively or additionally, the furthest downstream end of filter material in the filter may be spaced sufficiently far upstream of the mouth end of the filter such that the visibility of any staining of the furthest downstream end of filter material in the filter is reduced. In this case, preferably the furthest downstream end of filter material in the filter is at least about 4 mm from the mouth end of the filter, more preferably at least about 6 mm from the mouth end of the filter, and even more preferably at least about 8 mm from the mouth end of the filter.

In embodiments in which no plugs or discs are provided downstream of the filter segment containing the flow restrictor, the furthest downstream end of filter material is defined by the furthest downstream filter material of the filter segment containing the flow restrictor. However, in other embodiments, in which one or more plugs or discs are provided downstream of the filter segment containing the flow restrictor, the furthest downstream end of the one or more plugs or discs defines the furthest downstream end of filter material in the filter.

In one embodiment, the filter further comprises a hollow tube axially aligned with the filter segment. The hollow tube may allow the filter to have a desired (for example, standard) length, whilst using a reduced amount of filter material. Preferably, the hollow tube is downstream of the filter segment. Preferably, the hollow tube is at the mouth end of the filter. The hollow tube may comprise any material or materials including, but not limited, to paper, cardboard, filter material for example cellulose acetate, any thermoplastic, starch, polylactic acid, polyvinyl alcohol, poly(butylene succinate) and its copolymers, poly(butylene adipate-co-terephthalate) and combinations thereof. The hollow tube may be between approximately 5 mm and approximately 15 mm long. The hollow tube and filter segment may be overwrapped with a filter wrapper.

The filter may include a filter wrapper circumscribing at least the filter material. A filter wrapper provides strength and structural rigidity for the filter segment. Preferably, where the filter includes one or more additional filter elements, the filter segment and the one or more additional filter elements are overwrapped with a filter wrapper. The filter wrapper may comprise any suitable material. Preferably, the filter wrapper is a stiff plug wrap, for example comprising stiff paper or cardboard. The stiff paper or cardboard preferably has a basis weight greater than about 60 $gm^{-2}$. A stiff filter wrapper provides high structural rigidity. The filter wrapper may prevent deformation on the outside of the filter segment at the location where the flow restrictor is embedded in the filter material. The filter wrapper may include a seam including one or more lines of adhesive. Preferably, the seam includes two lines of adhesive. One line of adhesive may comprise a hot melt adhesive. One line of adhesive may comprise polyvinyl alcohol.

Preferably, the filter has a length $L_F$ between about 15 mm and about 40 mm. Even more preferably, the filter has a length $L_F$ between about 18 mm and about 27 mm. In one embodiment, the filter has a length $L_F$ of about 27 mm. In a preferred embodiment, however, the filter has a length $L_F$ of about 21 mm. The reduced length is possible because the design of the filter according to the invention allows the desired RTD to be achieved in a shorter length. This is particularly advantageous because it requires less filter material. If the filter does not include additional filter elements upstream or downstream of the filter segment, the length of the filter segment is equal to the length of the filter. If the filter does include additional filter elements upstream or downstream or both upstream and downstream of the filter, the length of the filter segment is less than the length of the whole filter. The length of the filter segment will depend on the additional filter element or elements.

In accordance with conventional manufacturing techniques, double length filters may be formed, then the double length filters may be attached to two aerosol forming substrates, one at each end, and then the double length filters may be cut in half, to thereby produce two smoking articles. In that case, the filter length is double that needed for a single smoking article. For example, if the smoking article filter has a length $L_F$ between about 15 mm and about 40 mm, a double length filter may have a length between about 30 mm and about 80 mm. If the smoking article filter has a length $L_F$ between about 18 mm and about 27 mm, a double length filter may have a length between about 36 mm and about 54 mm. If the smoking article filter has a length $L_F$ of about 27 mm, a double length filter may have a length of about 54 mm. If the smoking article filter has a length $L_F$ of about 21 mm, a double length filter may have a length of about 42 mm.

The longitudinal position of the centre of the flow restrictor in the filter may be selected to provide the desired level of RTD. For example, the longitudinal position of the centre of the flow restrictor may be at least about 6 mm from the downstream end of the filter. In this specification, the "centre" of the flow restrictor refers to the mid-point between the part of the flow restrictor disposed closest to the downstream end of the filter and the part of the flow restrictor disposed closest to the upstream end of the filter.

Filters according to the present invention may advantageously be used in filter cigarettes and other smoking articles in which tobacco material is combusted to form smoke. Filters according to the present invention may alternatively be used in smoking articles in which tobacco material is heated, rather than combusted, to form an aerosol. Filters according to the present invention may also be used in smoking articles in which a nicotine-containing aerosol is generated from a tobacco material, tobacco extract, or other nicotine source, without combustion or heating.

According to a second aspect of the invention, there is provided a smoking article comprising: an aerosol forming substrate; and a filter according to the first aspect of the invention. According to a second aspect of the invention, there is provided a smoking article comprising: a tobacco rod; and a filter according to the first aspect of the invention.

Preferably, the smoking article further comprises tipping material attaching the tobacco rod or other aerosol forming substrate and the filter. The tipping material may provide additional strength and structural rigidity for the filter segment and reduce the chance of deformation on the outer surface of the filter segment at the location where the flow restrictor is embedded in the filter material. The tipping material may include a ventilation zone comprising perforations through the tipping material. The tipping material may include at least one row of perforations to provide ventilation of the mainstream smoke. If the filter includes a filter wrapper, preferably, the perforations extend through the filter wrapper. Alternatively, the filter wrapper may be permeable. The tipping material may be standard pre-perforated tipping material. Alternatively, the tipping material may be perforated (for example, using a laser) during the manufacturing process according to the desired number, size and position of the perforations. The number, size and position of the perforations may be selected to provide the desired level of ventilation. The ventilation, in conjunction with the flow restrictor and the filter material, produces the desired level of RTD.

Preferably, the at least one circumferential row of perforations is at least about 1 mm downstream of the centre of the flow restrictor. More preferably, the at least one circumferential row of perforations is at least about 3 mm downstream of the centre of the flow restrictor. Most preferably, the ventilation zone is placed downstream of the flow restrictor such that the ventilation air is introduced into a cavity or a filter element disposed downstream of the flow restrictor. This provides the optimal mix of ambient air drawn through the perforations and the air and smoke mixture flowing through the filter.

A further aspect of the invention is directed to the use of a flow restrictor to restrict air flow in a filter segment of a filter for a smoking article, wherein the filter segment has a diameter measured perpendicular to a longitudinal direction of the filter, the flow restrictor is embedded in the filter segment and surrounded on all sides by filter material of the filter segment, and a cross sectional dimension of the flow restrictor measured perpendicular to a longitudinal direction of the filter is between about 60% and about 95% of the diameter of the filter segment, and wherein the flow restrictor is substantially spherical, the cross sectional dimension of the flow restrictor measured perpendicular to a longitudinal direction of the filter being a diameter of the spherical flow restrictor.

According to a further aspect of the invention, there is provided a method for manufacturing filters for smoking articles, the method comprising the steps of: providing a continuous rod of filter material having flow restrictors embedded in the filter material and spaced apart in the longitudinal direction of the rod, wherein each flow restrictor is substantially spherical, and wherein a diameter of each flow restrictor measured perpendicular to the longitudinal direction of the rod is between about 60% and about 95% of the diameter of the rod; and cutting the continuous rod of filter material at longitudinally spaced cut lines, to produce filter segments of filter material, each filter segment including a flow restrictor embedded in the filter segment and surrounded on all sides by the filter material.

The method of the invention is straightforward since the flow restrictors are incorporated directly into the filter material. For example, the flow restrictors may be incorporated with fibres of filter material as they are bundled to form filter material tow. No separate step of inserting the flow restrictor is required.

The method may further comprise the steps of: axially aligning a hollow tube with each filter segment; and overwrapping the filter segment and hollow tube with a filter wrapper.

Features described in relation to one aspect of the invention may also be applicable to another aspect of the invention.

The invention will be further described, by way of example only, with reference to the accompanying drawings in which.

Figure 1:
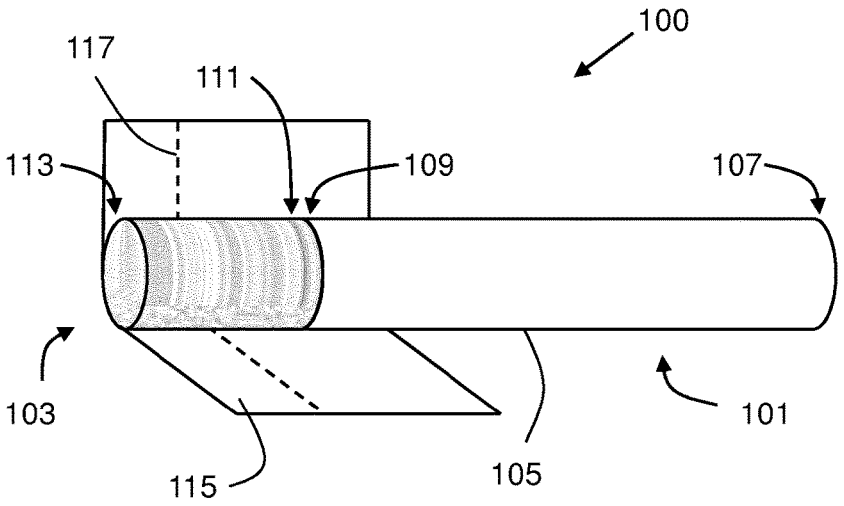
FIG. 1 is a perspective view of a smoking article according to one embodiment of the invention.

FIG. 1 is a perspective view of a smoking article 100 according to one embodiment of the invention. The smoking article 100 includes a generally cylindrical tobacco rod 101 and a generally cylindrical filter 103. The tobacco rod 101 and filter 103 are axially aligned in an end-to-end relationship, preferably abutting one another. The tobacco rod includes an outer wrapper 105 circumscribing the smoking material. The outer wrapper 105 may be a porous wrapping material or paper wrapper. The tobacco is preferably a shredded tobacco or tobacco cut filler. The tobacco rod 101 has an upstream, lit end 107 and a downstream end 109. The filter 103 has an upstream end 111 and a downstream, mouth end 113. The upstream end 111 of the filter 103 is adjacent the downstream end 109 of the tobacco rod 101. Although not visible in FIG. 1, a flow restrictor is embedded in the filter 103.

The filter 103 is attached to the tobacco rod 101 by tipping material 115 which circumscribes the entire length of the filter 103 and an adjacent region of the tobacco rod 101. The tipping material 115 is shown partially removed from the smoking article in FIG. 1, for clarity. The tipping material 115 is typically a paper like product. However, any suitable material can be used. In this embodiment, the tipping material 115 includes a circumferential row of perforations 117 aligned with the filter 103. The perforations are provided for ventilation of the mainstream smoke.

In this specification, the "upstream" and "downstream" relative positions between smoking article components are described in relation to the direction of mainstream smoke as it is drawn from the tobacco rod 101 and through the filter 103.

Figure 2:
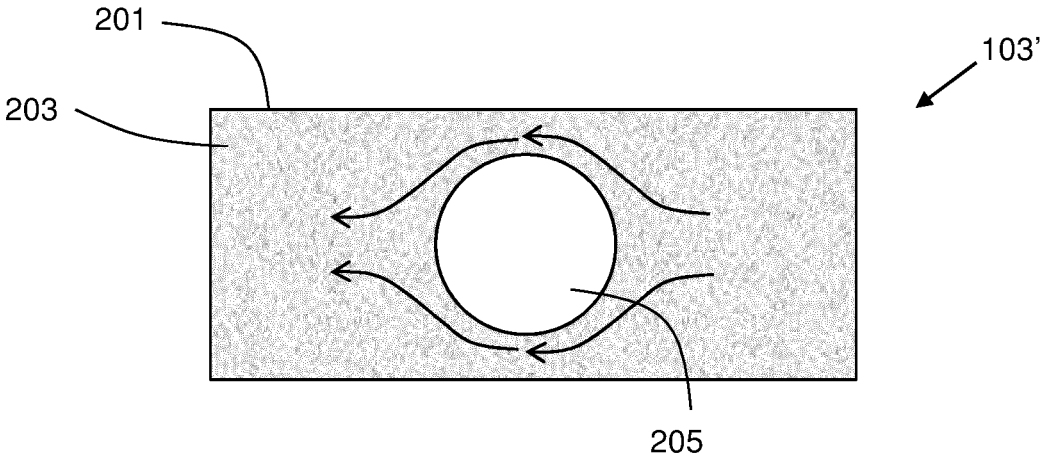
FIG. 2 is a cross sectional view of a filter according to a first embodiment of the invention.

FIG. 2 is a cross sectional view of a filter 103' according to a first embodiment of the invention. The filter 103' may be used in the smoking article of FIG. 1. In FIG. 2, the filter 103' comprises a filter segment 201 of filter material 203. The filter 103' further comprises a flow restrictor, in the form of bead 205. In the embodiment of FIG. 2, the flow restricting bead 205 comprises air-impermeable material. The flow restricting bead 205 is embedded in the filter segment 201 and is surrounded on all sides by the filter material 203. As shown schematically by the arrows, air drawn through the filter 103' during use of the smoking article is forced to flow around the flow restricting bead 205 and through a reduced cross section of filter material 203. In FIG. 2, the diameter of the filter 103' is 7.7 mm, the diameter of the flow restricting bead 205 is 6.0 mm (about 78% of the diameter of the filter), the length of the filter 103' is 21 mm and the centre of the flow restricting bead 205 is 11 mm from the downstream end of the filter 103'. When the filter is circumscribed by tipping material, the diameter of the filter may be 7.73 mm.

Figure 3:
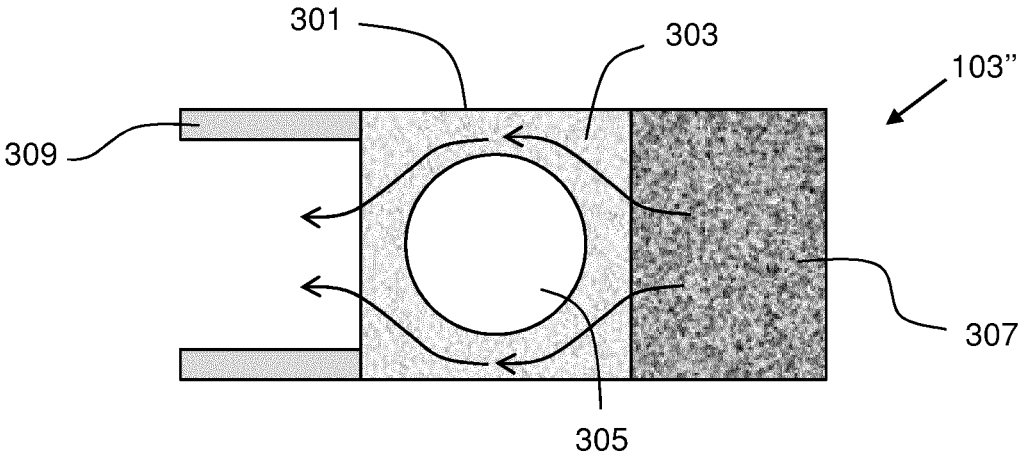
FIG. 3 is a cross sectional view of a filter according to a second embodiment of the invention.

FIG. 3 is a cross sectional view of a filter 103" according to a second embodiment of the invention. The filter 103" may be used in the smoking article of FIG. 1. In the embodiment of FIG. 2, the filter segment 201 comprises the entire filter 103'. However, in the embodiment of FIG. 3, the filter 103" includes additional elements. Specifically, in FIG. 3, the filter 103" comprises a filter segment 301 of filter material 303. The filter 103" further comprises a flow restrictor, in the form of bead 305, embedded in the filter segment 301 and surrounded on all sides by the filter material 303. In the embodiment of FIG. 3, the flow restricting bead 305 comprises air-impermeable material. The filter 103" further comprises a filter plug 307 and a hollow tube 309. The filter segment 301, filter plug 307 and hollow tube 309 are axially aligned in an end-to-end relationship. In FIG. 3, the filter plug 307 is upstream of the filter segment 301 and the hollow tube 309 is downstream of the filter segment 301. The filter plug 307 may comprise any suitable filter material. The hollow tube 309 may comprise any suitable material, for example paper or filter material. Because the filter 103" is open at the mouth end, thereby forming a mouth end cavity, visible staining of the mouth end is reduced. As shown schematically by the arrows, air drawn through the filter 103" during use of the smoking article is forced to flow around the flow restricting bead 305 and through a reduced cross section of filter material 303. In FIG. 3, the diameter of the filter 103" is 7.7 mm, the diameter of the flow restricting bead 305 is 6.0 mm (about 78% of the diameter of the filter), the length of the whole filter 103" is 27 mm, the length of the filter plug 307 is 9 mm, the length of the filter segment 301 is 8 mm, the length of the hollow tube 309 is 10 mm, and the centre of the flow restricting bead 305 is 14 mm from the downstream end of the filter 103" and 4 mm from the downstream end of the filter segment 301. When the filter is circumscribed by tipping material, the diameter of the filter may be 7.73 mm.

In FIG. 3, the filter includes additional filter elements both upstream and downstream of the filter segment 301. However, it will be appreciated that an additional element may be included only downstream of the filter segment 301 or only upstream of the filter segment 301. Alternatively, no additional filter elements may be provided, as shown in FIG. 2. In addition, in FIG. 3, the upstream additional filter element comprises a plug of filter material. However, any suitable filter element, including but not limited to a disc of filter material and a hollow tube, may alternatively be provided upstream of the filter segment 301. Similarly, in FIG. 3, the downstream additional filter element comprises a hollow tube. However, any suitable filter element, including but not limited to a plug of filter material and a disc of filter material, may alternatively be provided downstream of the filter segment 301.

When either the filter 103' of FIG. 2 or the filter 103" of FIG. 3 is incorporated into a smoking article like that shown in FIG. 1, preferably the perforations 117 are at least 1 mm downstream of the flow restricting bead 205, 305. The combination of the ventilation provided by perforations 117, the flow restricting bead 205, 305 and the filter material 203, 303 provides the desired RTD.

Figure 4:
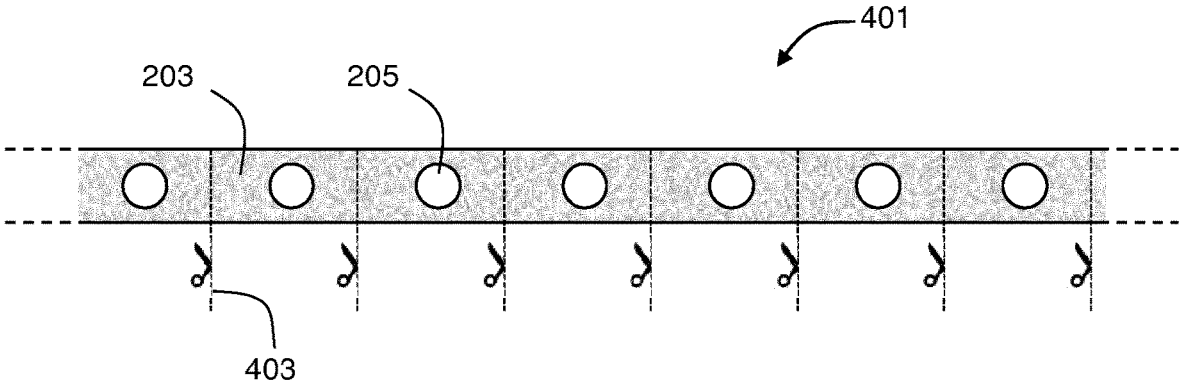
FIG. 4 is a cross sectional view of a continuous filter rod for manufacturing filters according to an embodiment of the invention.

It will be appreciated by the skilled person that the filter 103' of FIG. 2 may be manufactured from a continuous rod of filter material, in accordance with conventional manufacturing techniques. For example, as shown in FIG. 4, a continuous filter rod 401 of filter material 203 can be manufactured, with flow restricting beads 205 longitudinally spaced along the continuous filter rod 401. The flow restricting beads 205 are embedded in the continuous filter rod 401 and surrounded on all sides by the filter material 203. The flow restricting beads 205 are preferably incorporated as the raw filter material (for example, cellulose acetate) is spun as continuous synthetic fibres into a bundle (for example, cellulose acetate tow) in the form of the continuous filter rod. The continuous rod 401 may then be cut into individual filters 103' by cutting along cut lines 403. The longitudinal spacing of the flow restricting beads 205 and the cut lines 403 may be set according to the desired length of the filter and the desired position of the flow restricting beads within the filter.

Similarly, the filter segment 301 of the filter 103" of FIG. 3 may be manufactured from a continuous rod of filter material, in a similar way to that shown in FIG. 4. The longitudinal spacing of the flow restricting beads and the cut lines may be set according to the desired length of the filter segment and the desired position of the flow restricting beads within the filter segment.

The invention claimed is:

1. A filter for a smoking article, the filter comprising:

a filter segment of filter material, the filter segment having a diameter measured perpendicular to a longitudinal direction of the filter; and a flow restrictor embedded in the filter segment and surrounded on all sides by the filter material, wherein the flow restrictor is solid, a cross sectional dimension of the flow restrictor measured perpendicular to a longitudinal direction of the filter is between about 60% and about 95% of the diameter of the filter segment, and wherein the flow restrictor is substantially spherical, the cross sectional dimension of the flow restrictor measured perpendicular to the longitudinal direction of the filter being a diameter of the flow restrictor, and wherein the flow restrictor has a compressive strength at a deformation of 10% greater than about 50.0 kPa.

2. The filter according to claim 1, wherein the cross sectional dimension of the flow restrictor is between about 70% and about 80% of the diameter of the filter segment.

3. The filter according to claim 1, wherein the flow restrictor has a compressive yield strength greater than about 8.0 kPa.

4. The filter according to claim 1, wherein the filter forms a mouth end cavity.

5. The filter according to claim 1, further comprising a hollow tube axially aligned with the filter segment.

6. The filter according to claim 1, further comprising a filter wrapper circumscribing at least the filter material.

7. The filter according to claim 1, wherein the centre of the flow restrictor is at least about 6 mm from the downstream end of the filter.

8. A smoking article, comprising:

a tobacco rod; and a filter according to claim 1.

9. The smoking article according to claim 8, further comprising tipping material attaching the tobacco rod and the filter, the tipping material including a ventilation zone comprising perforations through the tipping material.

10. The smoking article according to claim 9, wherein the tipping material includes at least one circumferential row of perforations at least about 1 mm downstream of the centre of the flow restrictor.

11. A method for manufacturing a filter according to claim 1, the method comprising the steps of:

providing a continuous rod of filter material having flow restrictors embedded in the filter material and spaced apart in the longitudinal direction of the rod, wherein each flow restrictor is solid and substantially spherical, and a diameter of each flow restrictor measured perpendicular to the longitudinal direction of the rod is between about 60% and about 95% of the diameter of the rod; and cutting the continuous rod of filter material at longitudinally spaced cut lines, to produce filter segments of filter material, each filter segment including a flow restrictor embedded in the filter segment and surrounded on all sides by the filter material.

12. The method according to claim 11, further comprising the steps of:

axially aligning a hollow tube with each filter segment; and overwrapping the filter segment and hollow tube with a filter wrapper.

* * * * *